US005283083A

United States Patent [19]

Paz-Pujalt et al.

[11] Patent Number: 5,283,083

[45] Date of Patent: Feb. 1, 1994

[54] METALORGANIC DECOMPOSITION METHOD FOR PREPARING A METAL BORATE

[75] Inventors: Gustavo R. Paz-Pujalt, Rochester, N.Y.; Wenjiang Nie, Chalon-sur-Saone, France

[73] Assignee: Eastman Kodak Company, Rochester, N.Y.

[21] Appl. No.: 954,994

[22] Filed: Oct. 1, 1992

[30] Foreign Application Priority Data

Dec. 16, 1991 [FR] France ..... 91 15844

[51] Int. Cl.[5] ..... B05D 3/02

[52] U.S. Cl. ..... 427/227; 427/380; 427/384

[58] Field of Search ..... 427/255.3, 385.5, 227, 427/384, 380

[56] References Cited

U.S. PATENT DOCUMENTS 3,330,697 7/1967 Pechini ..... 117/215
4,480,770 11/1984 Goursat et al. ..... 222/590
5,017,551 5/1991 Agostinelli et al. ..... 505/1

FOREIGN PATENT DOCUMENTS 334093 9/1989 European Pat. Off. .

*Primary Examiner*—Bernard Pianalto
*Attorney, Agent, or Firm*—Robert Luke Walker

[57] ABSTRACT

The present invention concerns a method for preparing metal borate.

The method consists in forming a metal ligand and a boron alkoxide and to react them to form a metal-borate precursor, which is then thermally treated to form an inorganic film on a substrate.

The method is especially useful to prepare beta barium borate layers which can serve in non-linear optical devices to produce second harmonics generation.

8 Claims, No Drawings

METALORGANIC DECOMPOSITION METHOD FOR PREPARING A METAL BORATE

BACKGROUND OF THE INVENTION

The present invention concerns a method for preparing metal borates and more particularly thin films of metal borate, e.g. barium borate and articles comprising such metal borates.

Beta-barium borate ($\beta$-BBO) is one of the materials having non-linear optical properties, and more particularly having the capacity in a certain range of wavelength, to produce a second harmonic generation of frequency 2w when it is subjected to incident radiation of frequency w. Unlike most other materials with usual sources of incident radiation, this second harmonic generation (SHG) is of sufficient amplitude to be observed and manipulated.

Another advantage of $\beta$-BBO is that its optical damage threshold is high, i.e. 3–4 times the threshold of potassium dihydrogenphosphate, which is used as a reference material in non-linear optics. This means that $\beta$-BBO can be used with short pulse, high power lasers as sources of incident radiation without being damaged. Also, $\beta$-BBO can be used for non-linear optics within a range of temperatures which is broader than for any other material.

To be actually usable in non-linear integrated optical devices, however, a material needs to be obtainable in single crystal or in crystalline thin film forms, on appropriate substrates.

Various methods are known to prepare such thin films on substrates. Most of these methods are complex, expensive, provide non-uniform films with uncontrolled stoichiometry and do not permit the easy introduction of dopants in a quantitatively controlled manner. Some of these problems may be partially overcome by tedious and time consuming trial and error combinations of the chemical elements in question in order to achieve thin films with the desired composition ratios. Finally, it is generally difficult to deposit thin film on irregular geometries.

Another well known approach for the deposition of thin films is by metallo-organic decomposition (MOD). MOD for preparing inorganic films is described in U.S. Pat. Nos. 3,330,697 and 4,480,770. MOD consists in depositing a solution containing metal precursors in the desired ratios, onto a substrate. These precursors are then thermally decomposed to form an inorganic thin film. Further thermal treatments result in the formation of the desired phase. However, a requirement for the MOD method is to find precursors which decompose quantitatively and are not water-sensitive. MOD was thought not to be a good candidate for preparing thin films of $\beta$-BBO, since materials generally known as boron precursors are water-sensitive and do not decompose quantitatively.

The present invention eliminates the above difficulties and provides a way to use the MOD method for preparing metal borates and especially thin films of metal borate such as $\beta$-BBO with precise atomic ratios on various substrates and without requiring expensive and complex deposition systems or the preliminary preparation of powders of the desired material.

SUMMARY OF THE INVENTION

The method according to the invention allows the formation of a borate of one or more metals on various substrates and comprises the steps of:

(a) preparing a metal-ligand compound of said metal(s), (b) reacting this metal-ligand compound with a boron alkoxide in the presence of a volatizable film-forming solvent and a polyhydric compound, to form a metal borate precursor, (c) thermally decomposing the precursor so that the solvent and the ligand are removed and an inorganic metal borate is formed.

DESCRIPTION OF A SPECIFIC EMBODIMENT

According to a preferred embodiment, the method according to the invention allows the formation of a film of a borate of one or more metals on various substrates and comprises the steps of:

(a) preparing a metal-ligand compound of said metal(s), (b) reacting this metal-ligand compound with a boron alkoxide in the presence of a volatizable film-forming solvent and a polyhydric compound, to form a metal borate precursor, (c) coating the solution of metal borate precursor on the subtrate, and (d) thermally decomposing the precursor so that the solvent and the ligand are removed and a thin film of metal borate is formed.

The term "metal" refers to any metal of the periodic Table. Preferably, the metal is an alkaline earth metal, i.e. a metal of group 2 of the Periodic Table such as, calcium, strontium or barium.

According to a specific and preferred embodiment, the method of the invention is especially suitable to prepare beta BBO, and comprises the following steps:

(a) preparation of a barium-ligand compound as a barium precursor;

(b) reaction of this barium-ligand compound with a boron alkoxide in the presence of a volatizable film-forming solvent and a polyhydric compound;

(c) coating of the barium borate precursor obtained in step (b) on a substrate; and (d) thermally decomposing and treating the barium borate precursor.

Applicants do not intend to be bound by theoretical considerations herein. They believe that an important feature of the method according to the invention is the sequence of steps whereby a barium precursor is reacted with a boron alkoxide in the presence of a polyhydric compound, to produce by in-situ polymerization a stable, water-stable and non-volatile polymeric barium borate precursor, which can be then coated in thin film and thermally treated.

Such polyhydric compounds include water-soluble polyols such as glycerols, ethylene glycol, propane diols, butane diols, pentanediols, hexanediols, etc. erythrols such as erythrol or penta erythrol, pentols, hexols such as aliphatic hexols or cycloaliphatic hexols, monosaccharides or amino-alcohols.

Various ligands can be used to prepare the barium precursor. Suitable ligands include aliphatic carboxylic acids or carboxylates, such as octanoates, 2-ethyl-hexanoates, neodecanoates, aromatic carboxylic acids or carboxylates such as naphthenate, benzene dicarboxylate, resinate, etc. Other compounds that can serve as the metal-ligand precursor are metallo organic compounds such as alkoxides, beta diketone derivatives. The number of carbon atoms in the organic ligand can vary over a wide range but is typically more than 2 and limited to less than 30 to avoid unnecessarily reducing the proportion of metal ions present.

Carboxylate ligands are particularly advantageous in promoting metal ligand solubility. While very simple organic ligands such as acetate ligands can be used, it is generally preferred to choose higher ligands, e.g. containing more than 4 carbon atoms, in order to avoid crystallization on solvent removal, which is detrimental to the molecular level uniformity of the components of the film. It will be appreciated that useful metal ligand compounds are soluble compounds having limited or no volability at ambient temperatures, which are reactable with the boron alkoxides to form the metal-boron precursor. In order to avoid loss of material during the preparation of the film of metal boron oxide, metal-ligand compounds having any significant volatility below their decomposition temperature are not preferred.

Instead of increasing the molecular bulk or modifying the chain configuration of organic ligands to avoid any propensity toward metallo-organic compound crystallization on solvent removal, another technique which can be employed is to incorporate in the film forming solvent a separate compound to act as a film promoting agent, such as a higher molecular weight branched chain organic compound. This can, for example, take the form of a branched chain hydrocarbon or substituted hydrocarbon, such as a terpene having from about 10 to 30 carbon atoms.

The film forming solvents can be chosen from a wide range of volatilizable liquids. The primary function of the solvent is to provide a liquid phase permitting molecular level intermixing of the metallo-organic compounds chosen. The liquid is also chosen for its ability to cover the substrate uniformly. Thus, an optimum film forming solvent selection is in part determined by the choice of substrate. Generally more desirable film forming properties are observed with more viscous solvents and those which more readily wet the substrate alone, or with an incorporated wetting agent, such as a surfactant, present.

The MOD process can be also carried out in water solution, which permits the avoidance of the solvent recovery steps needed to prevent solvent release into the environment.

Exemplary preferred organic ligands for metallo-organic compounds include metal 2-ethylhexanoates, naphthenates, neodecanoates, butoxides, isopropoxides, rosinates (e.g., abietates) cyclohexanebutyrates, and acetylacetonates. Exemplary preferred film forming agents include 2-ethylhexanoic acid, rosin (e.g. abietic acid), ethyl lactate, 2-ethoxyethyl acetate, pinene, toluene, n-butyl acetate, propanol, and mineral spirits.

Various boron alkoxides can be used to form the metal boron oxide precursor. Preferred ones are those derived from lower aliphatic alcohols, i.e. those having from 1 to 8 carbon atoms such as methoxide, ethoxide, propoxide, butoxide, amyloxide etc.

As previously noted, the metal-ligand compounds and the boron precursor are used in the proportions desired in the final thin crystalline film. The metal ligand compounds can be incorporated in the film-forming solvent in any convenient concentration up to their saturation limit at ambient temperature. Generally, a concentration is chosen which provides the desired film thickness for the process sequence.

Where the geometry of the substrate permits, uniformity and thickness of the metal-ligand coating can be controlled by spin-coating, that is, coating the surface of the substrate then spinning the substrate around an axis normal to the surface of the substrate. A significant advantage of spin coating is that the thickness of the coating at the conclusion of spinning is determined by the contact angle and viscosity of the coating composition and the rate and time of spinning, all of which can be precisely controlled. Differences in the amount of coating composition applied to the substrate are not reflected in the thickness of the final coating. Centrifugal forces generated by spinning cause excess material to be rejected peripherally from the article. Thicker layers may be achieved by successive coating/thermal treatment cycles.

According to the process of the invention, once prepared, the metallo-organic solution containing barium and boron at the desired ratios used as the precursor, is coated onto the substrate by any known coating method, such as spin coating, dip coating, spraying, doctor blading, etc.

The resulting metallo-organic precursor film is then subjected to a thermal treatment to remove solvents and addenda (such as polyhydric compounds) and to decompose, i.e. thermally cleave, the organic ligands attached to boron and the metal, respectively. This results in an inorganic film consisting of boron oxide and metal oxide or carbonate, which upon continued thermal treatment, is modified to produce the crystalline desired phase of metal borate. In the case of beta BBO films, the thermal treatment of the precursor produces in a first step an inorganic film consisting of boron oxide and barium carbonate, which, upon continued treatment produces the desired phase $BaB_2O_4$.

Although processing temperatures employed in forming the inorganic film and in subsequently converting it to a crystalline film can vary significantly, depending upon the specific film composition, crystallization is achieved at a lower temperature than that which would cause the film to decompose and the inorganics to react with the substrate or volatilize. In a preferred embodiment, crystallization is achieved at temperatures between 500° C. and 1000° C., depending on the efficiency of the energy transfer of the film. For instance, laser annealing might provide enough local heating for the film to crystallize, while the substrate is not brought to a high temperature. Optimum temperatures for crystallization vary somewhat, depending on the ratios of the components of the film.

To heat the film and the substrate, various methods can be used. Uniform heating can be accomplished employing any conventional oven. In some instances, however, either to protect the substrate from rising to the peak temperatures encountered by the film or simply to avoid the investment in an oven, it is contemplated that the film will be selectively heated. This can be accomplished by employing a radiant heat source such as a lamp, e.g. a quartz lamp. Lamps of this type are commercially available for achieving rapid thermal annealing of various conventional layers and can be readily applied to the practice of the invention. These lamps rapidly transmit high levels of electromagnetic energy to the film, allowing it to be brought to its crystallization temperature without placing the substrate in an oven. Patterning by laser sources can be performed on the organic films in order to achieve a pattern consisting of BBO lines.

Preferred substrates for the film are those which are inert or minimally interactive with the metal-borate film deposited thereon. It is generally preferred to select substrates from among materials which exhibit relatively limited interaction with the metal borate film during its formation. Description of useful substrates is provided in European Patent No. 334,093 or in U.S. Pat. No. 5,017,551.

To avoid the interaction between the film and the substrate, it is also possible to insert a barrier layer, e.g. layer of boron silicate between the substrate and the film.

The following examples illustrate the invention.

EXAMPLE 1

Preparation of a Barium Ligand

A barium ligand was prepared from the following reactants:

0.01 mole of barium hydroxyde 0.025 mole of 2-ethylhexanoic acid (slight molar excess), and 50 ml of toluene.

The acid and one half of the toluene were mixed and warmed up to the refluxing temperature. The barium hydroxyde was then mixed with the other half of toluene and the resulting slurry was added slowly to the acid toluene refluxed mixture. The exothermic reaction was carefully controlled and water produced was removed before accumulation and interaction with the resulting barium carboxylate. When the addition of barium and toluene was completed, the mixture was allowed to reflux a few more minutes and was then filtered, concentrated and assayed for metal contents.

Thermogravimetric analysis showed a residue containing 14.65 weight percent of barium.

EXAMPLE 2

Preparation of Barium Borate Precursor

A barium borate precursor was prepared from the following reactants:

2.10 g of barium-ligand (as obtained in example 1);

1.03 g of boron tributoxide;

0.42 g of glycerol; and 0.25 g of methyl alcohol.

The above ingredients were mixed with stirring. A clear colorless liquor was obtained.

EXAMPLE 3

Preparation of β-BBO Film 1 ml of the liquid precursor obtained in example 2was deposited by spin coating at 5000 rpm during 20 s onto a clear fused silica wafer. The precursor layer and its substrate were then heated to 800° C. during 5 minutes. An inorganic film was obtained on the silica wafer. Second harmonics generation at 0.532 pm is observed by irradiating the material with a Nd:YAb laser at 1.06 μm.

EXAMPLE 4

Aqueous β-BBO Precursor 1.03 g of boric acid and 2.18 g of barium acetate (2:1 mole ratio) were dissolved in about 20 ml of water. Although the solution was subjected to low heating (<100° C.) and stirring for one hour, it stayed cloudy. A few ml of concentrated acetic acid was added to increase the solubility of boric acid. After this acidification and moderate heating, the solution remained clear. TGA of the resulting precursor showed about 8.8 weight percent of residue (BaB2O4) after heating up to 1000° C.

A composition of BBO, ethylactate and glycerol (weight 6:2:1) was spin coated onto a substrate.

While a specific embodiment of the invention has been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

We claim:

1. A process to form a film of a borate of one or more metals on a substrate comprising the steps of:

(a) preparing a metal-ligand compound of said metal(s), (b) reacting this metal-ligand compound with a boron alkoxide in the presence of a volatizable film-forming solvent and a polyhydric compound, to form a metal borate precursor (c) coating the solution of metal borate precursor on the substrate, and, (d) thermally decomposing the precursor so that the solvent and the ligand are removed and a thin film of metal borate is formed.

2. The process of claim 1, wherein the polyhydric compound is a water-soluble polyol.

3. The process of claim 1, wherein step (d) further comprises decomposing said precursor into metal borate and heating said metal borate to its crystallization temperature.

4. The process of claim 1, wherein the ligand is an organic compound of 2–20 carbon atoms.

5. The process of claim 1, wherein the alkoxide radical of the boron alkoxide is derived from an aliphatic alcohol having 1–6 carbon atoms.

6. The process of claim 1, wherein the metal is an alkaline earth metal or a rare earth metal.

7. The process of claim 1, wherein the heating step comprises at least one step for removal of solvent and ligands, and a step for the crystallization of the film.

8. The process of claim 1, wherein the metal borate is beta barium borate.

* * * * *